US008991814B2

(12) United States Patent
Hirahara

(10) Patent No.: US 8,991,814 B2
(45) Date of Patent: Mar. 31, 2015

(54) SHEET FEED DEVICE AND IMAGE FORMING APPARATUS INCLUDING THE SAME

(71) Applicant: KYOCERA Document Solutions Inc., Osaka (JP)

(72) Inventor: Kazuhisa Hirahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/257,738

(22) Filed: Apr. 21, 2014

(65) Prior Publication Data

US 2014/0319756 A1 Oct. 30, 2014

(30) Foreign Application Priority Data

Apr. 26, 2013 (JP) ..... 2013-094420

(51) Int. Cl.
*B65H 3/06* (2006.01)
*B65H 1/26* (2006.01)

(52) U.S. Cl.
CPC ..... *B65H 3/0684* (2013.01); *B65H 1/266* (2013.01)
USPC ..... 271/117; 271/147; 271/162; 271/164

(58) Field of Classification Search
CPC ..... B65H 3/0684; B65H 1/266; B65H 3/0615
USPC ..... 271/117, 147, 164, 145, 162, 109
See application file for complete search history.

(56) References Cited

U.S. PATENT DOCUMENTS

| | | | | |
|---|---|---|---|---|
| 5,139,252 | A * | 8/1992 | Morita et al. | 271/117 |
| 5,419,544 | A * | 5/1995 | Ono et al. | 271/164 |
| 7,472,904 | B2 * | 1/2009 | Park | 271/117 |
| 8,523,173 | B2 * | 9/2013 | Hayayumi | 271/117 |

FOREIGN PATENT DOCUMENTS

| | | | | |
|---|---|---|---|---|
| JP | 61002632 | A * | 1/1986 | B65H 3/52 |
| JP | 2004-284818 | A | 10/2004 | |

* cited by examiner

*Primary Examiner* — Prasad Gokhale
(74) *Attorney, Agent, or Firm* — Stein IP, LLC

(57) ABSTRACT

A sheet feed device is provided in which, at the time of pulling out a sheet housing portion from an image forming apparatus main body, when the sheet housing portion moves from a first position to a second position, a pickup roller moves on a first rotary shaft, to a position on an upstream side in an insertion direction, and at the time of inserting the sheet housing portion in the image forming apparatus main body, when the sheet housing portion moves from the second position to the first position, the pickup roller moves on the first rotary shaft, to a position on a downstream side in the insertion direction. A movable area of the pickup roller in a direction of the rotary shaft is equal to or larger than a movement amount of the pickup roller between the upstream side position and the downstream side position.

11 Claims, 6 Drawing Sheets

SHEET FEED DEVICE AND IMAGE FORMING APPARATUS INCLUDING THE SAME

CROSS-REFERENCE TO RELATED APPLICATIONS

This application is based on and claims the benefit of priority from Japanese Patent Application No. 2013-94420, filed on Apr. 26, 2013, filed in the Japanese Patent Office. All disclosures of the document(s) named above are incorporated herein by reference.

BACKGROUND OF THE INVENTION

The present disclosure relates to a sheet feed device used to stock beforehand a multitude of sheets, such as paper sheets, to be supplied to an image forming apparatus and to feed the sheets thus stocked one by one, and the image forming apparatus incorporating the sheet feed device.

In an image forming apparatus represented by a copy machine or a printer, a paper feed cassette is used for feeding paper such as cut paper. The paper feed cassette is stocked beforehand with a multitude of paper sheets before printing and supplies, from an uppermost layer of a stack of the paper sheets stacked in the cassette, the paper sheets one by one separately from each other.

The paper feed cassette is provided with a sheet stacking plate having an upper surface on which paper sheets are placed. The paper sheets are stacked on the sheet stacking plate that is biased upward, and at a cassette mounting position in the image forming apparatus, a pickup roller provided on an image forming apparatus main body side comes in contact with an upper surface of an uppermost one of the paper sheets. Then, the pickup roller turns, causing the paper sheets to be fed out in order in a feed direction by a frictional force between the pickup roller and the uppermost one of the paper sheets.

By the way, in a paper feed device in which a paper feed cassette is disposed such that an insertion/pull-out direction thereof is orthogonal to a feed direction of a paper sheet, in a case where, when the paper feed cassette is inserted/pulled out for the purpose of paper sheet replenishment or the like, paper sheets stacked therein come in contact with a pickup roller while the insertion/pulling out of the paper feed cassette is in progress or have been in contact therewith prior to the insertion/pulling out of the paper feed cassette, the contact with the pickup roller causes an uppermost one of the paper sheets to be misaligned in the cassette insertion/pull-out direction, resulting in a problem that a paper sheet is fed out in an obliquely oriented state. Moreover, problems such as causing a paper sheet to be flawed or torn or causing a paper sheet to fall off from the paper feed cassette also are likely to occur. Also, the contact between the pickup roller and the paper sheets interferes with the insertion/pulling out of the cassette. In addition, there may occur sagging of a paper sheet between a width alignment cursor that regulates a paper sheet position in the direction orthogonal to the feed direction and the pickup roller, resulting in bending of the paper sheet at its end portion or a paper jam.

As a measure to solve these problems, there is known, for example, a paper feed, device including a pickup roller support body that supports a pickup roller to an apparatus main body such that the pickup roller is swingable in such a direction as to approach/separate from an upper surface of a paper sheet and a swing control body that is mounted to the apparatus main body such that it is movable substantially integrally with a cassette in accordance with insertion/pulling out of the cassette and controls a swing position of the pickup roller support body (position to which the pickup roller support body is swung). In the paper feed device, in accordance with insertion/pulling out of the cassette, the pickup roller is made to swing to be positioned as follows. That is, at the time of inserting the cassette, as the cassette approaches a mounting position of the cassette, the pickup roller swings to be positioned so as to increasingly come into contact with an upper surface of a paper sheet, and at the time of pulling out the cassette, as the cassette separates from the mounting position, the pickup roller swings to be positioned so as to increasingly separate from the upper surface of the paper sheet.

SUMMARY OF THE INVENTION

A sheet feed device according to a first aspect of the present disclosure includes a sheet housing portion, a sheet stacking plate, a pickup roller, a feed mechanism, a first bracket, an arm, and a feed roller mounting shaft. The sheet housing portion can be inserted in and pulled out from an image forming apparatus main body. The sheet stacking plate is pivotably supported, at an end portion thereof on an upstream side in a sheet feed direction, to a bottom surface of the sheet housing portion, and an end portion thereof on a downstream side in the sheet feed direction moves up and down between a placement position at which sheets are set and a feed position at which the sheets are fed. The pickup roller comes in contact with an upper surface of a plurality of sheets stacked on the sheet stacking plate and feeds out, one by one, an uppermost one of the sheets in a direction orthogonal to an insertion direction or a pull-out direction of the sheet housing portion. The feed mechanism feeds, by using a feed roller disposed on the downstream side in the sheet feed direction with respect to the pickup roller, a sheet fed out by the pickup roller. The first bracket has a first rotary shaft to which the pickup roller is supported so as to be slidable in an axial direction thereof, and is swingably supported to the image forming apparatus main body. The arm is mounted to the image forming apparatus main body and is movable together with the sheet housing portion in the insertion direction or the pull-out direction in accordance with insertion or pulling out of the sheet housing portion. Further, the arm makes the first bracket swing between a feed position where, when the sheet housing portion is at a first position at which mounting of the sheet housing portion in the image forming apparatus main body is completed, the arm makes sliding contact with the first bracket, and the pickup roller comes into contact with an upper surface of the sheets housed in the sheet housing portion, and a separation position where, when the sheet housing portion is at a second position to which the sheet housing portion has moved from the first position to a downstream side in the pull-out direction, the pickup roller separates from the upper surface of the sheets. The feed roller mounting shaft drives the feed roller to rotate and functions as a swing center of the first bracket. Then, at the time of pulling out the sheet housing portion from the image forming apparatus main body, when the sheet housing portion moves from the first position to the second position, the pickup roller moves on the first rotary shaft, through frictional contact with the upper surface of the sheets, to a position on an upstream side in the insertion direction, and at the time of inserting the sheet housing portion in the image forming apparatus main body, when the sheet housing portion moves from the second position to the first position, the pickup roller moves on the first rotary shaft, through frictional contact with the upper surface of the sheets, to a position on a downstream side in the insertion direction. A movable area of the pickup roller in a direction of the first rotary shaft is equal to or larger than a movement amount of the pickup roller between the position on the upstream side and the position on the downstream side.

Still other objects of the present disclosure and specific advantages provided by the present disclosure will be made further apparent from the following description of an embodiment.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

With reference to the appended drawings, the following describes in detail an embodiment of the present disclosure.

Figure 1:
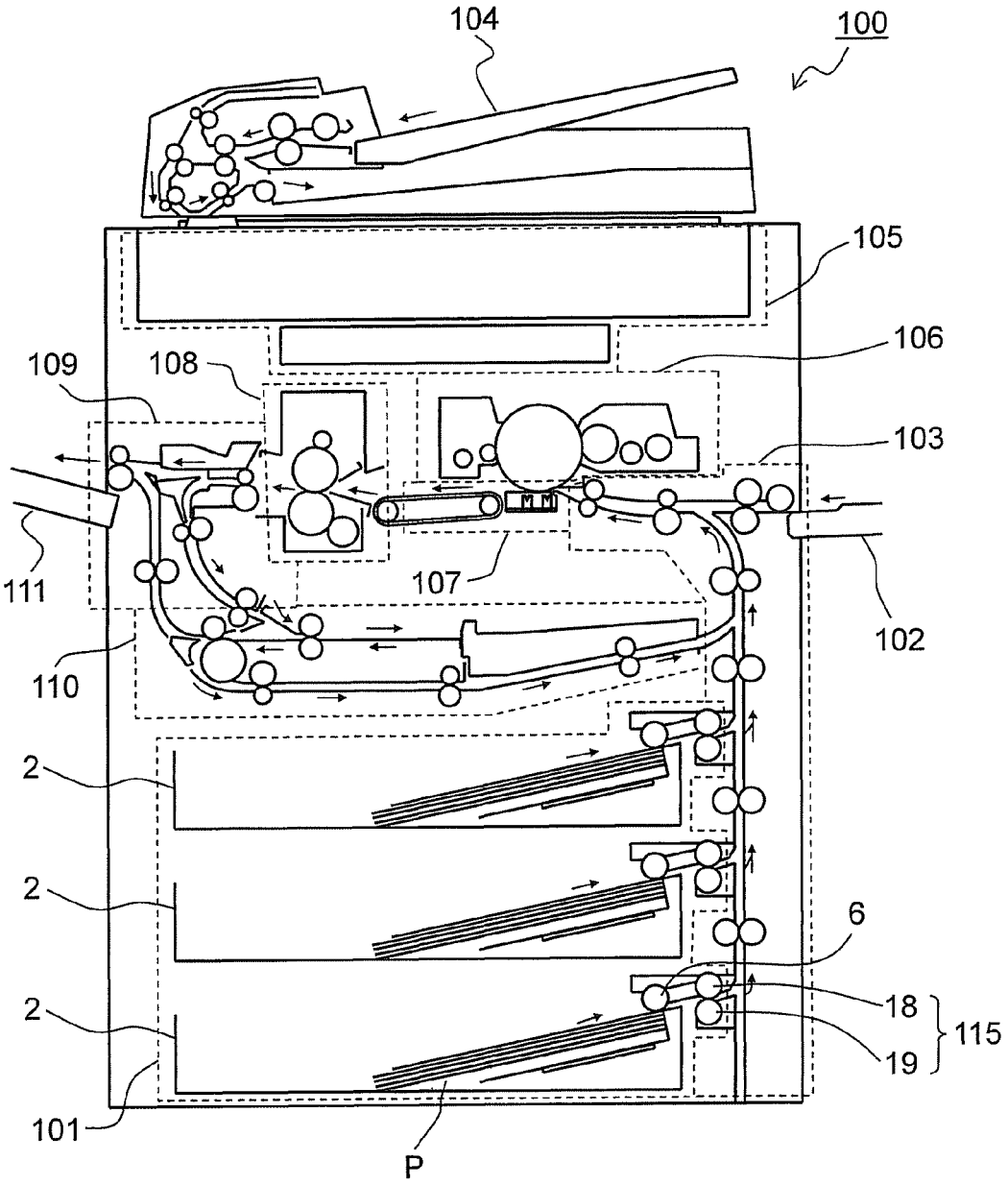
FIG. 1 is a sectional side view showing an internal structure of an image forming apparatus 100 incorporating a sheet feed device 1 of the present disclosure.

FIG. 1 is a sectional side view showing an internal structure of an image forming apparatus 100 incorporating a paper feed cassette 2 as a constituent component of a sheet feed device 1 according to one embodiment of the present disclosure. Solid line arrows in the figure indicate conveying routes and conveying directions of a paper sheet.

In FIG. 1, at a lower portion in the image forming apparatus 100, a cassette-type paper feed portion 101 is disposed. The cassette-type paper feed portion 101 is provided with a plurality of (herein, three) paper feed cassettes 2. Inside each of the paper feed cassettes 2, sheets of paper P before printing such as cut paper are housed in a stacked manner, and by a pickup roller 6 and a paper feed roller pair 115 composed of a feed roller 18 and a retardation roller 19, the sheets of paper P are fed out one by one separately from each other.

A manual paper feed portion 102 is provided outside an upper portion of a right side surface of the image forming apparatus 100. On the manual paper feed portion 102, a recording medium to be fed one by one, such as a sheet of paper P of a type different in size and/or thickness from the paper P housed in the cassette-type paper feed portion 101, an OHP sheet, an envelope, a postcard, or an invoice, is placed.

In the image forming apparatus 100, a paper sheet conveying portion 103 is disposed. The paper sheet conveying portion 103 is positioned, with respect to the cassette-type paper feed portion 101, on a right side that is a downstream side in a paper feed direction and, with respect to the manual paper feed portion 102, on a left side that is a downstream side in the paper feed direction. By the paper sheet conveying portion 103, a sheet of the paper P fed out from the cassette-type paper feed portion 101 is conveyed perpendicularly upward along the side surface of a main body of the image forming apparatus 100, while a sheet of the paper P fed out from the manual paper feed portion 102 is conveyed horizontally.

On an upper surface of the image forming apparatus 100, an original document conveying device 104 is disposed, below which an image reading portion 105 is disposed. In a case of performing copying of an original document, a plurality of original documents on which images such as characters, graphics, and patterns are drawn are stacked on the original document conveying device 104. In the original document conveying device 104, the original documents are fed out one by one separately from each other, and by the image reading portion 105, the images on the original documents are read. The images thus read are converted into image data.

On a downstream side in a paper sheet conveying direction of the paper sheet conveying portion 103 and below the image reading portion 105, an image forming portion 106 and a transfer portion 107 are disposed. In the image forming portion 106, based on image data of an image on an original document read by the image reading portion 105, an electrostatic latent image is formed, which then is developed into a toner image. On the other hand, in synchronization with a timing at which the toner image is formed in the image forming portion 106, a sheet of the paper P is conveyed from the cassette-type paper feed portion 101 to the transfer portion 107 via the paper sheet conveying portion 103. The toner image formed in the image forming portion 106 is transferred onto the sheet of the paper P in the transfer portion 107.

On a downstream side with respect to the transfer portion 107, a fixing portion 108 is disposed. The sheet of the paper P onto which the toner image in an unfixed state thus has been transferred in the transfer portion 108 is conveyed to the fixing portion 108, where it passes through a nip portion between a fixing roller pair composed of a heating roller and a pressing roller, and thus the unfixed toner image on the sheet of the paper P is fixed into a permanent image.

On a downstream side with respect to the fixing portion 108 and in a neighborhood of a left side surface of the image forming apparatus 100, an ejection • branching portion 109 is disposed. In a case where double-sided printing is not performed, the sheet of the paper P after being ejected from the fixing portion 108 is ejected from the ejection branching portion 109 onto a paper sheet ejection tray 111 provided on an outer side of the left side surface of the image forming apparatus 100.

Below a portion extending from the image forming portion 106 over to the ejection • branching portion 109 and above the cassette-type paper feed portion 101, a double-sided printing unit 110 is disposed. In a case where double-sided printing is performed, the sheet of the paper P after being ejected from the fixing portion 108 is sent to the double-sided printing unit 110 via the ejection • branching portion 109. The sheet of the paper P sent to the double-sided printing unit 110 is turned upside down by switching back, and again passing through the paper sheet conveying portion 103 to be conveyed, with a surface thereof on which no image has yet been formed facing upward, to the transfer portion 107.

Figure 2:
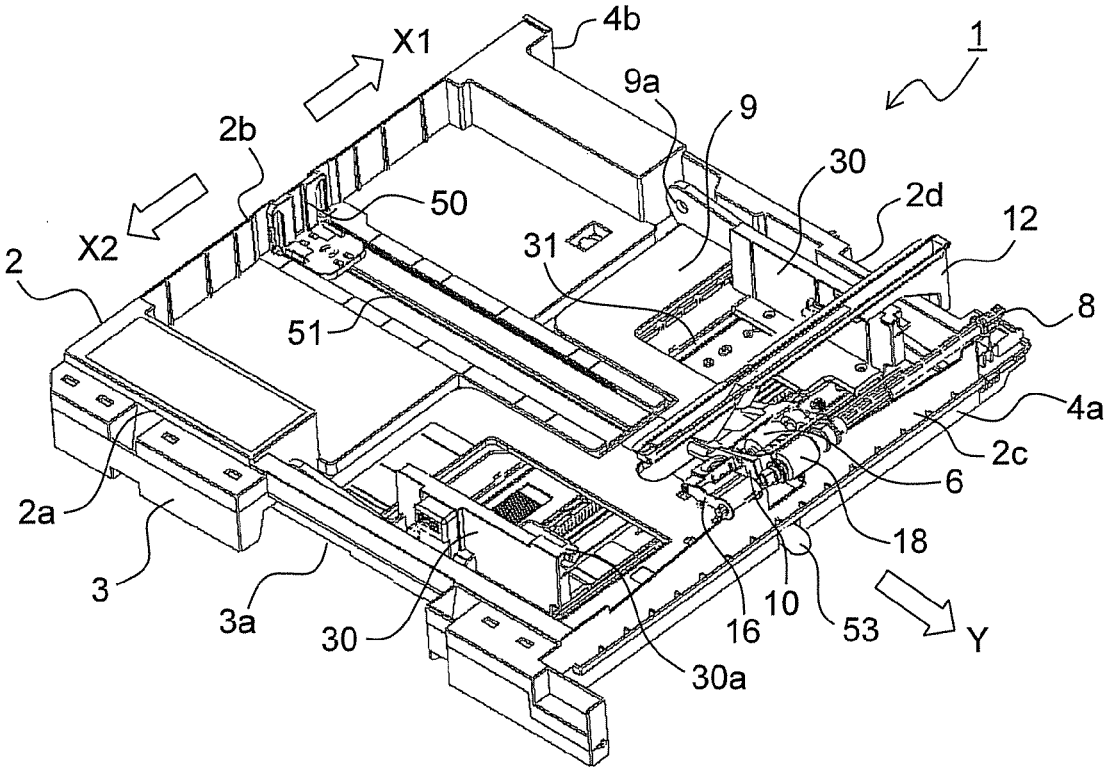
FIG. 2 is a perspective view, as seen from above, of the sheet feed device 1 according to one embodiment of the present disclosure.
Figure 3:
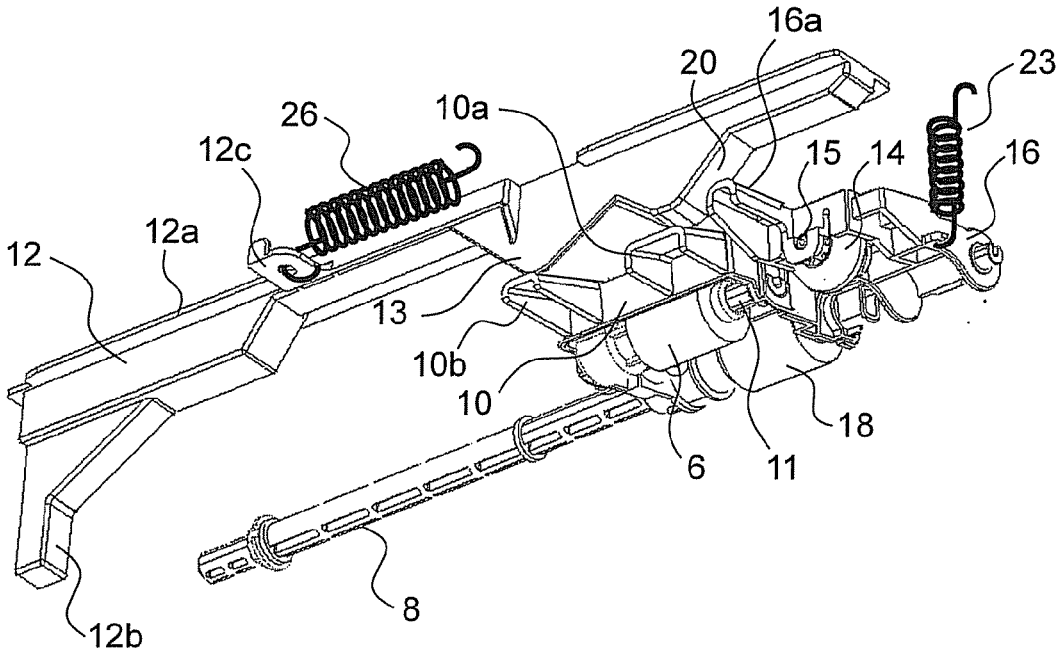
FIG. 3 is a perspective view of a first bracket 10, a second bracket 16, and an arm 12 as constituent components of the sheet feed device 1 of this embodiment.
Figure 4:
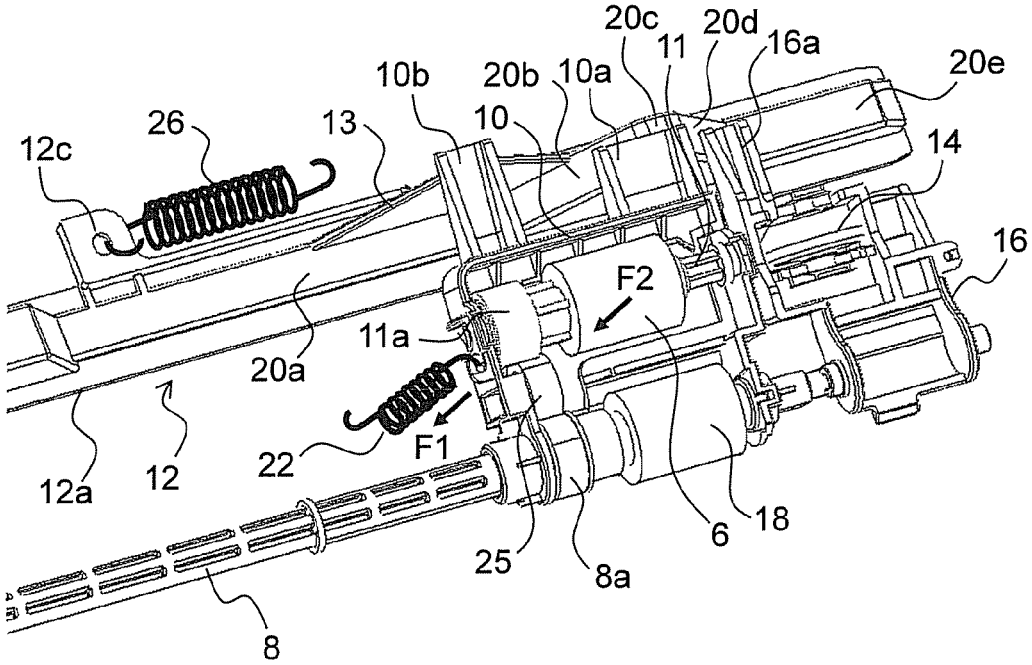
FIG. 4 is a partially enlarged view, as seen from a lower direction in FIG. 3, of a vicinity of the first bracket 10 and the second bracket 16.

FIG. 2 is a perspective view, as seen from above, of the sheet feed device 1 according to one embodiment of the present disclosure. Furthermore, FIG. 3 is a perspective view of a first bracket 10, a second bracket 16, and an arm 12 as constituent components of the sheet feed device 1 of this embodiment, and FIG. 4 is a partially enlarged view, as seen from a lower direction in FIG. 3, of a vicinity of the first bracket 10 and the second bracket 16. With reference to FIGS. 2 to 4, a description is given of a detailed configuration of the sheet feed device 1 of the present disclosure.

The sheet feed device 1 includes the paper feed cassette 2 that is provided in the main body of the image forming apparatus 100 (see FIG. 1) such that it can be inserted and pulled out, respectively, in directions indicated by arrows X1 and X2, a sheet stacking plate 9 that is pivotably supported, at an end portion thereof on an upstream side in the paper feed direction, to a bottom surface of the paper feed cassette 2 and has an upper surface on which a stack of paper sheets (not shown) are placed, the pickup roller 6 that, in a state where the paper feed cassette 2 is mounted in the main body of the image forming apparatus 100, comes in contact with an upper surface of the stack of paper sheets stacked on the sheet stacking plate 9 and feeds out, one by one, an uppermost one of the paper sheets in a direction (arrow Y direction) orthogonal to an insertion/pull-out direction (arrow X1 and X2 directions), the first bracket 10 that is swingably supported to a feed roller mounting shaft 8 extending in the insertion/pull-out direction of the paper feed cassette 2 in the main body of the image forming apparatus 100 and is a support body supporting the pickup roller 6, and the arm 12 that is mounted to the main body of the image forming apparatus 100 such that it is movable together with the paper feed cassette 2 in accordance with insertion/pulling out of the paper feed cassette 2 and controls a swing position of the first bracket 10.

The paper feed cassette 2 is configured in the shape of a flat box having an open upper surface, and from a direction of the upper surface, paper sheets are housed therein in a stacked manner. Inside the image forming apparatus 100, the pickup roller 6 is disposed above the paper feed cassette 2, and the paper sheets are supplied in the arrow Y direction shown in FIG. 2. At a front wall portion (wall portion on a near side in an insertion direction) X1) 2*a* of the paper feed cassette 2, a housing cover 3 is formed integrally therewith and constitutes part of a housing at a lower portion of a front surface of the image forming apparatus 100. The housing cover 3 is provided with a handle 3*a* used for an insertion/pull-out operation. At a left wall portion 2*b* and a right wall portion 2*c* of the paper feed cassette 2, rails 4*a* and 4*b* for supporting the paper feed cassette 2 in the main body of the image forming apparatus 100 such that it can be inserted therein/pulled out therefrom are provided, respectively.

On an inner side on the bottom surface of the paper feed cassette 2, the sheet stacking plate 9 on which paper sheets are stacked is mounted. The sheet stacking plate 9 is supported on the inner side on the bottom surface of the paper feed cassette 2, with one end thereof on the upstream side in the paper feed direction used as a pivotal fulcrum 9*a,* and thus is swingable up and down, with an end portion thereof on a downstream side in the paper feed direction (end portion thereof on a pickup roller 6 side) used as a free end. The sheet stacking plate 9 is biased upward in a swing direction by a compression spring (not shown). The sheet stacking plate 9 is a plate-shaped member having notches provided correspondingly to movement regions of a width regulation cursor 30 and a back end regulation cursor 50, which will be described later.

At both sides of the sheet stacking plate 9 in a direction orthogonal to the paper feed direction, a pair of the width regulation cursors 30 are provided so as to stand along the paper feed direction (arrow Y direction). The width regulation cursors 30 make contact, from both sides in a paper sheet width direction orthogonal to the paper feed direction, with side surfaces of a stack of paper sheets stacked on the sheet stacking plate 9, thereby performing alignment of the paper sheets in a width direction thereof so that the paper sheets are positioned at a paper feed position at which the paper sheets are fed by the pickup roller 6 and the paper feed roller pair 115. The width regulation cursors 30 are movable along a width regulation cursor movement groove 31 provided on the inner side on the bottom surface of the paper feed cassette 2 and extending in the paper sheet width direction.

At an upper end portion of the width regulation cursors 30 on a swing end side of the sheet stacking plate 9, a lug portion 30*a* protruding to a sheet stacking plate 9 side is provided to prevent the level of a top end of a stack of paper sheets stacked on the sheet stacking plate 9 from increasing beyond a prescribed level, thereby controlling an upper limit position of an upper surface of the stack of paper sheets.

On the upstream side in the paper feed direction inside the paper feed cassette 2, the back end regulation cursor 50 is provided. The back end regulation cursor 50 makes contact, from the upstream side in the paper feed direction, with a side surface of a stack of paper sheets stacked on the sheet stacking plate 9, thereby performing alignment of the paper sheets in the paper feed direction so that the paper sheets are positioned at the paper feed position at which the paper sheets are fed by the pickup roller 6 and the paper feed roller pair 115. The back end regulation cursor 50 is movable along a back end regulation cursor movement groove 51 provided on the inner side on the bottom surface of the paper feed cassette 2 and extending in the paper feed direction.

Furthermore, at the right wall portion 2*c* of the paper feed cassette 2, there is provided a lock release member 53 that protrudes to an outer side of the right wall portion 2*c* by a biasing force of a spring (not shown) in the paper feed cassette 2. The lock release member 53 has an anchor lug (not shown) for pressing a swing end (right end in FIG. 2) of the sheet stacking plate 9, and when the sheet stacking plate 9 is pressed against the bottom surface of the paper feed cassette 2, the anchor lug presses the swing end of the sheet stacking plate 9, thus bringing the sheet stacking plate 9 to a locked state. In this state, the paper feed cassette 2 is inserted into the main body of the image forming apparatus 100, and upon a tip end portion of the lock release member 53 coming in contact with a contact piece (not shown) provided on a main body side, the lock release member 53 is once pressed to be retracted to an inner side of the right wall portion 2*c*. At this time, the anchor lug and the sheet stacking plate 9 are disengaged from each other, so that the locked state of the sheet stacking plate 9 is released.

The above-described paper feed device is configured so that, in accordance with insertion/pulling out of the paper feed cassette 2, the pickup roller 6 swings in such a direction as to approach or separate from a paper sheet, and so that, in order to prevent, at the time of inserting/pulling out the paper feed cassette 2, the pickup roller 6 from rubbing against an upper surface of the paper sheet, the pickup roller 6 is movable in a rotational axis direction thereof. The position of the pickup roller 6 in the rotational axis direction, therefore, is unfixed.

To be specific, in a state where the paper feed cassette 2 is mounted in an image forming apparatus 100 main body, the pickup roller 6 is being pressed by a paper sheet or the sheet stacking plate 9, and hence, when the paper feed cassette 2 is pulled out from the image forming apparatus 100 main body, the pickup roller 6 necessarily moves, following the paper feed cassette 2, to a near side with respect to the image forming apparatus 100 main body (downstream side in a pull-out direction). Accordingly, after the paper feed cassette 2 has been pulled out, the position of the pickup roller 6 is on a side closer to the near side.

Furthermore, in a case where the paper feed cassette 2 is inserted, with the sheet stacking plate 9 not being locked and thus being in a raised state, rubbing occurs between a paper sheet or the sheet stacking plate 9 and the pickup roller 6, causing the pickup roller 6 to move to a depth side of the image forming apparatus 100 main body (downstream side in an insertion direction), in which case, depending on a magnitude of a force with which the paper feed cassette 2 is inserted, the position of the pickup roller 6 somewhat varies.

Pulling out the paper feed cassette 2 from the image forming apparatus 100 main body in a state where the pickup roller 6 is on a side closer to the near side, however, renders it meaningless to have the configuration in which the pickup roller 6 is movable in the rotational axis direction, and may cause a paper sheet to be misaligned or damaged due to the pickup roller 6 rubbing against an upper surface of the paper sheet. For these reasons, pulling out of the paper feed cassette 2 from the image forming apparatus 100 main body should not be performed in a state where the position of the pickup roller 6 is on a side closer to the near side.

Next, with reference to FIGS. 3 and 4, a description is given of the pickup roller 6 and the first bracket 10 supporting the pickup roller 6. In the paper feed cassette 2, the first bracket 10 is arranged above a stack of paper sheets stacked on the sheet stacking plate 9 on a tip end portion side thereof (downstream side in the paper feed direction). The first bracket 10 is pivotably supported to the feed roller mounting shaft 8 mounted on the main body side of the image forming apparatus 100.

In the first bracket 10, at a side closer to a pivotal end thereof (a side closer to the upstream side in the paper feed direction), there is provided a first rotary shaft 11 parallel to the feed roller mounting shaft 8, to which the pickup roller 6 is mounted such that the pickup roller 6 is slidable only in an axial direction of the first rotary shaft 11. Furthermore, the feed roller mounting shaft 8 is provided additionally with a drive output gear 8*a*, and the first rotary shaft 11 is provided additionally with a drive input gear 11*a*. The drive output gear 8*a* is in mesh with the drive input gear 11*a* via an idle gear 25. When a rotary drive force from a drive motor (not shown) is inputted to the feed roller mounting shaft 8, the pickup roller 6, together with the feed roller 18, is driven to turn.

At the pivotal end (end portion on the upstream side in the paper feed direction) of the first bracket 10, there is formed a swing control portion 10*a* that is U-shaped in cross section when seen from a direction of the pivotal end. Moreover, by a tension coil spring 22, the first bracket 10 is elastically biased upward, i.e. in such a direction as to separate from a stack of paper sheets P stacked on the sheet stacking plate 9. In consequence thereof, the swing control portion 10*a* is in elastic contact with a guiding surface 20 (which will be described later) formed in the arm 12 and extending in a direction of the feed roller mounting shaft 8. Further, when the swing control portion 10*a* moves up and down along the guiding surface 20, the pickup roller 6 supported by the first bracket 10 also moves up and down.

As shown in FIG. 4, in an axial direction of the feed roller mounting shaft 8, the first bracket 10 supporting the pickup roller 6 is provided, at one end portion (right end portion in FIG. 4) thereof, with the swing control portion 10*a* that makes sliding contact with the guiding surface 20 of the arm 12, and the pickup roller 6 is provided at a center portion thereof. Furthermore, the tension coil spring 22 that biases the first bracket 10 upward is engaged with the other end portion (left end portion in FIG. 4) of the first bracket 10. Thus, an upward (downward in FIG. 4) biasing force F1 from the tension coil spring 22 acts on the other end portion of the first bracket 10, and an upward (downward in FIG. 4) biasing force F2 from the sheet stacking plate 9 (see FIG. 2) acts on the center portion of the first bracket 10 via the pickup roller 6.

Herein, when an attempt is made to receive the biasing forces F1 and F2 by the swing control portion 10*a* at the one end portion of the first bracket 10, a biased load trying to torsionally deform the first bracket 10 acts on the first bracket 10.

In order to avoid this, in this embodiment, there is provided a sliding contact portion 10*b* shaped similarly (U-shaped in cross section) to the swing control portion 10*a*. The sliding contact portion 10*b* is provided at a portion on a pivotal end portion side, which is away in the direction of the feed roller mounting shaft 8 from the swing control portion 10*a* and lies between acting points of the biasing forces F1 and F2 so as to be close to the acting point of the biasing force F1. In consequence thereof, the upward biasing forces F1 and F2 acting on the first bracket 10 are received at two locations, i.e., by the swing control portion 10*a* and the sliding contact portion 10*b*, and thus no biased load acts on the first bracket 10, so that the first bracket 10 can be prevented from being torsionally deformed.

The sheet feed device 1 further includes a paper press roller 14 and the second bracket 16 that is a support body supporting the paper press roller 14. The second bracket 16 supporting the paper press roller 14 is formed in a shape similar to that of the first bracket 10 supporting the pickup roller 6, and is pivotably supported to the feed roller mounting shaft 8 adjacently to the first bracket 10. In the second bracket 16, there is provided a second rotary shaft 15 orthogonal to an extending direction of the feed roller mounting shaft 8, and the paper press roller 14 is turnably mounted to the second rotary shaft 15. The paper press roller 14 rotates while being in contact with an upper surface of a stack of paper sheets at the time of an operation to insert the paper feed cassette 2 or at the time of an operation to pull it out, thereby preventing a paper sheet from being positionally misaligned in a width direction thereof.

The paper press roller 14 is only required to be able to rotate while being in contact with an upper surface of a stack of paper sheets. The paper press roller 14 may be made of an appropriate material such as, for example, plastic, rubber, or metal. In order to facillitate contact with an upper surface of a stack of paper sheets even in a case where the second bracket 16 is swung to be inclined or the stack of paper sheets are inclined due to the sheet stacking plate 9 being inclined, the paper press roller 14 is formed to have an annular roll surface 14*a* (see FIG. 9) that is circular arc-shaped in cross section on one side (sheet stacking plate 9 side) thereof.

At a pivotal end (end portion on the upstream side in the paper feed direction) of the second bracket 16, similarly to the first bracket 10, there is formed a swing control portion 16*a* formed to be U-shaped in cross section. Moreover, by a tension coil spring 23, the second bracket 16 is elastically biased upward, i.e., in such a direction as to separate from a stack of paper sheets stacked on the sheet stacking plate 9. In consequence thereof, the swing control portion 16*a* is in elastic contact with the guiding surface 20 formed in the arm 12 and extending in the axial direction of the feed roller mounting shaft 8. Further, when the swing control portion 16*a* moves up and down along the guiding surface 20, the paper press roller 14 supported by the second bracket 16 also moves up and down.

The arm 12 is a rod-shaped member extending, in the insertion/pull-out direction (X1 and X2 directions) of the paper feed cassette 2, to a length shorter than a width between the front wall portion 2*a* and a back wall portion 2*d* of the paper feed cassette 2. The arm 12 includes a strip plate-shaped top plate portion 12*a*, a protruding portion 12*b* that protrudes from one end of the top plate portion 12*a* toward the paper feed cassette 2 and faces an outer side of the back wall portion 2*d*, and the guiding surface 20 that is formed at a lower surface of the top plate portion 12*a*.

The arm 12 is mounted to the main body of the image forming apparatus 100 such that the top plate portion 12*a* is slidable in the insertion/pull-out direction (arrow X1 and) X2 directions), and a tension coil spring 26 is mounted between an engagement portion 12*c* provided at the top plate portion 12*a* and the main body of the image forming apparatus 100. In consequence thereof, the arm 12 is elastically biased in a pull-out direction (arrow X2 direction) of the paper feed cassette 2. Further, when the protruding portion 12*b* is in contact with the outer side of the back wall portion 2*d* (see FIG. 2) of the paper feed cassette 2, in conjunction with insertion/pulling out of the paper feed cassette 2, the arm 12 moves, together with the paper feed cassette 2, in the insertion/pull-out direction.

The guiding surface 20 extends in a longitudinal direction of the arm 12 and includes, in order from a protruding portion 12*b* side (left side in FIG. 5), a first guiding surface 20*a* that is substantially the same flat surface as the lower surface of the top plate portion 12*a*, a second guiding surface 20*b* that is smoothly inclined in such a direction as to separate from the first guiding surface 20*a*, a third guiding surface 20*c* that is continuous with the second guiding surface 20*b* and has a protruding arc shape, a fourth guiding surface 20*d* that is smoothly inclined from the third guiding surface 20*c* in such a direction as to approach the top plate portion 12*a*, and a fifth guiding surface 20*e* that is continuous with the fourth guiding surface 20*d* and has a height from the lower surface of the top plate portion 12*a*, which is larger than that of the first guiding surface 20*a* and smaller than that of the third guiding surface 20*c*. Furthermore, at the guiding surface 20, there is formed a guiding portion 13 with which the sliding contact portion 10*b* of the first bracket 10 makes sliding contact. The guiding portion 13 has an inclined surface having the same shape as that of the guiding surface 20 and is formed at a position misaligned with the guiding surface 20 in the paper feed direction (up-down direction in FIG. 4) and the insertion/pull-out direction (left-right direction in FIG. 4).

As will be described later, the respective shapes and dispositions of the guiding surfaces 20*a* to 20*e* and the guiding portion 13 are determined based on a relationship between a timing at which the pickup roller 6 and the paper press roller 14, which are swingably mounted, come in/out of contact with an upper surface of a stack of paper sheets in the paper feed cassette 2 and an insertion/pull-out position of the paper feed cassette 2 to which the paper feed cassette 2 is inserted or pulled out, in conjunction with which the arm 12 moves.

Figure 5:
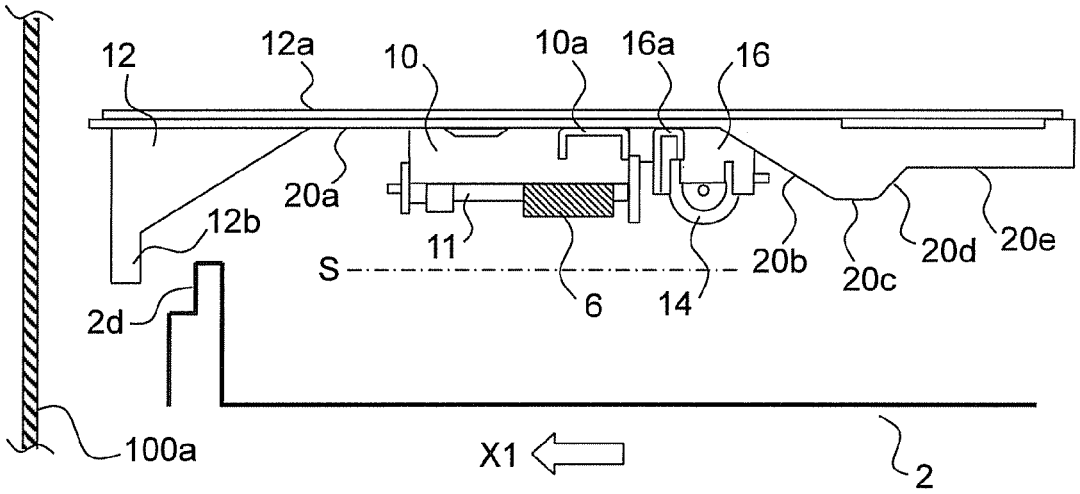
FIG. 5 is a view showing a relationship between respective dispositions of a pickup roller 6 and a paper press roller 14 and an insertion/pull-out position of a paper feed cassette 2 in a case where the paper feed cassette 2 is at an insertion start position or a pull-out completion position.
Figure 6:
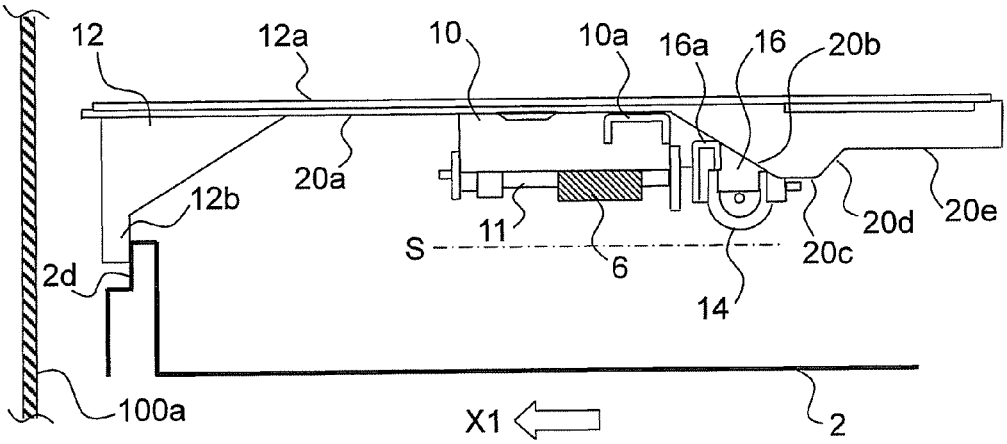
FIG. 6 is a view showing a relationship between respective dispositions of the pickup roller 6 and the paper press roller 14 and an insertion/pull-out position of the paper feed cassette 2 in a case where the paper feed cassette 2 has been inserted in an X1 direction by a prescribed amount from a position shown in FIG. 5.
Figure 7:
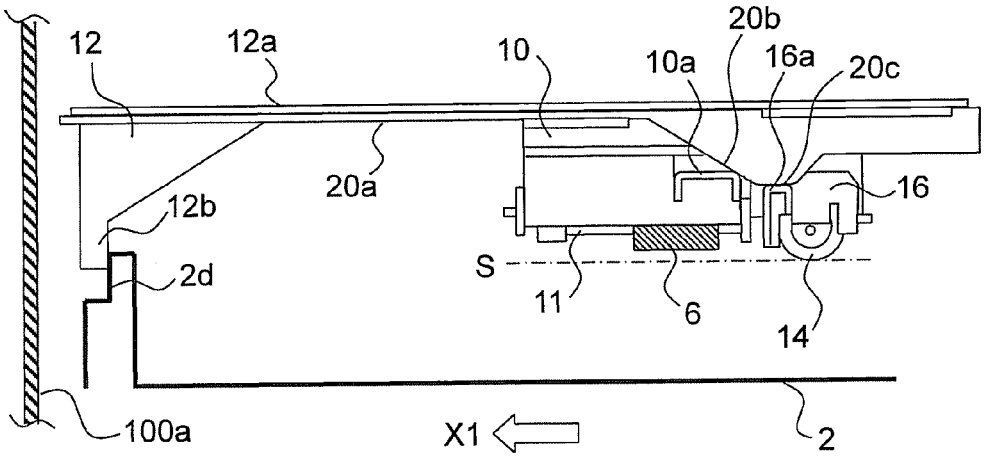
FIG. 7 is a view showing a relationship between respective dispositions of the pickup roller 6 and the paper press roller 14 and an insertion/pull-out position of the paper feed cassette 2 in a case where the paper feed cassette 2 has been inserted in the X1 direction by a prescribed amount from a position shown in FIG. 6.
Figure 8:
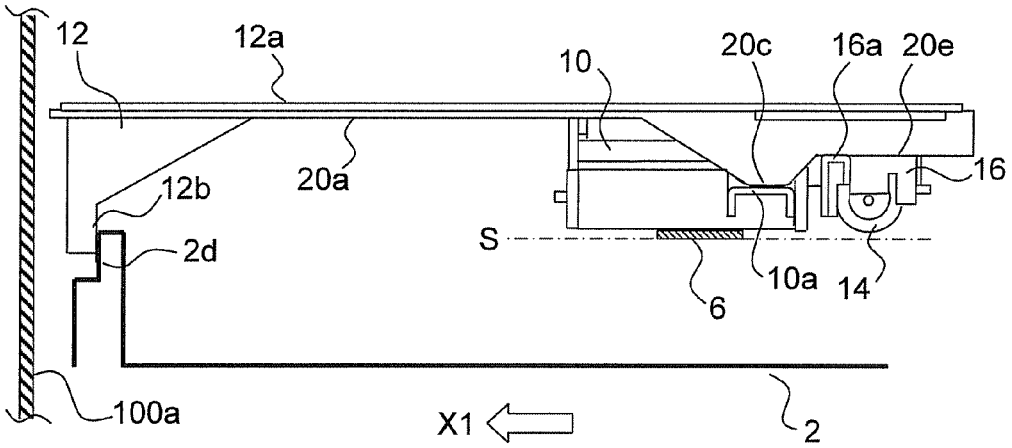
FIG. 8 is a view showing a relationship between respective dispositions of the pickup roller 6 and the paper press roller 14 and an insertion/pull-out position of the paper feeing cassette 2 in a case where the paper feed cassette 2 has been inserted to a second position.
Figure 9:
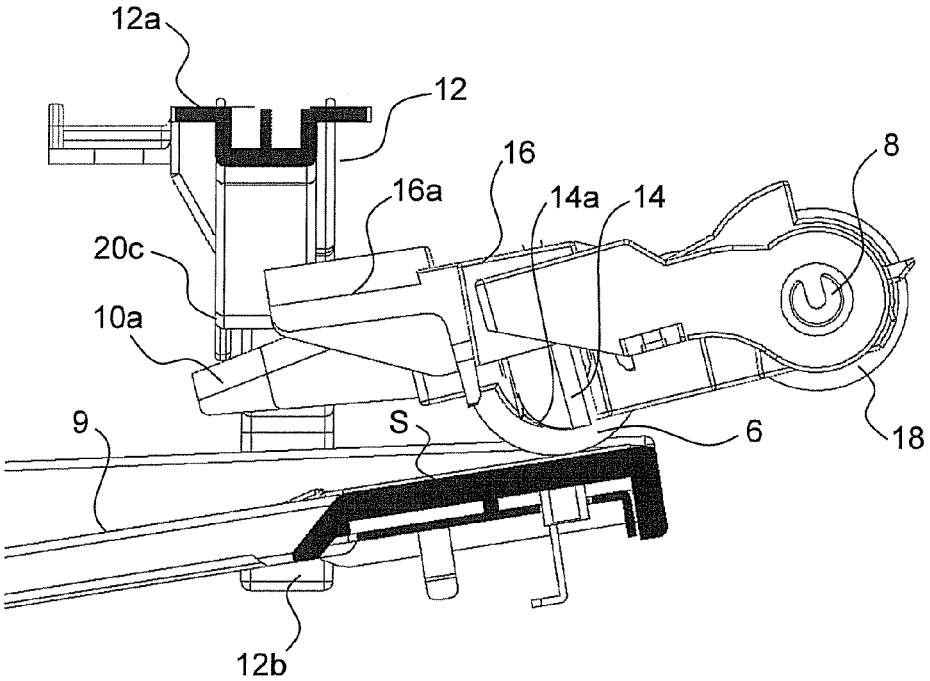
FIG. 9 is a view, as seen from an upstream side in an insertion direction of the paper feed cassette 2, of a positional relationship of the pickup roller 6 and the paper press roller 14 with a sheet stacking plate 9, which is shown in FIG. 8.
Figure 10:
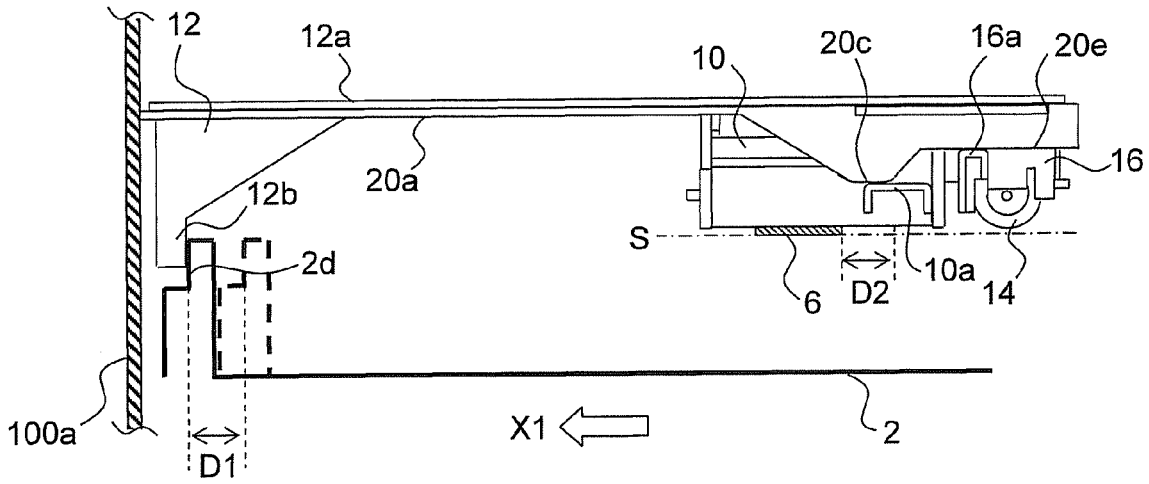
FIG. 10 is a view showing a relationship between respective dispositions of the pickup roller 6 and the paper press roller 14 and an insertion/pull-out position of the paper feed cassette 2 in a case where the paper feed cassette 2 has reached a first position.

FIGS. 5 to 8 and FIG. 10 are explanatory views, as seen from the upstream side in the paper feed direction (left depth side in FIG. 2), showing a relationship between respective dispositions of the pickup roller 6 and the paper press roller 14 and the insertion/pull-out position of the paper feed cassette 2. FIG. 5 shows an insertion start position or a pull-out completion position of the paper feed cassette 2, FIG. 10 shows a position (hereinafter, referred to as a first position) of the paper feed cassette 2 at which mounting of the paper feed cassette 2 in the main body of the image forming apparatus 100 is completed, and FIGS. 6 to 8 show positions of the paper feed cassette 2 at different stages in the process of being mounted therein. FIG. 9 is a view, as seen from an upstream side in the insertion direction (X1 direction) of the paper feed cassette 2, of a positional relationship of the pickup roller 6 and the paper press roller 14 with the sheet stacking plate 9, which is shown in FIG. 8.

As shown in FIG. 5, when the paper feed cassette 2 is at the insertion start position or the pull-out completion position, the swing control portion 10*a* of the first bracket 10 supporting the pickup roller 6 and the swing control portion 16*a* of the second bracket 16 supporting the paper press roller 14 are each in contact with the first guiding surface 20*a* of the arm 12, and the pickup roller 6 and the paper press roller 14 are disposed at their respective positions most distant from an upper limit position S (indicated by an alternate long and short dashed line in the figures) of a stack of paper sheets P (or the sheet stacking plate 9). The upper limit position S refers to a position (paper feed position) of an uppermost surface of a stack of paper sheets when the sheet stacking plate 9 is in an raised state. In a state shown in FIG. 5, as a result of an operation to pull out the paper feed cassette 2, the pickup roller 6 is disposed on a most upstream side in the insertion direction (X1 direction). Furthermore, before being inserted in the main body of the image forming apparatus 100, the paper feed cassette 2 is in a state where the sheet stacking plate 9 is locked with respect to the bottom surface by use of the anchor lug of the lock release member 53 (see FIG. 2).

When the paper feed cassette 2 is inserted, from the position shown in FIG. 5, by a prescribed amount in a direction of a depth-side wall 100*a* (X1 direction) of the main body of the image forming apparatus 100, the back wall surface 2*d* of the paper feed cassette 2 comes in contact with the protruding portion 12*b* of the arm 12, and then the arm 12 moves, together with the paper feed cassette 2, in the X1 direction against a biasing force of the tension coil spring 26. As a result, as shown in FIG. 6, the swing control portion 10*a* of the first bracket 10 stays in contact with the first guiding surface 20*a*, and the swing control portion 16*a* of the second bracket 16 comes in contact with the second guiding surface 20*b*. Further, the paper press roller 14 swings in such a direction as to approach the upper limit position S more closely than the pickup roller 6 does. Though not described below, the sliding contact portion 10*b* of the first bracket 10 comes in contact with the guiding portion 13 and thus also swings up and down at the same timing as that of the swing control portion 10*a*.

When the paper feed cassette 2 is inserted further, from the position shown in FIG. 6, by a prescribed amount in the X1 direction, the arm 12 also moves further, together with the paper feed cassette 2, in the X1 direction. As a result, as shown in FIG. 7, the swing control portion 10*a* of the first bracket 10 comes in contact with the second guiding surface 20*b*, and the swing control portion 16*a* of the second bracket 16 comes in contact with a tip end of the third guiding surface 20*c* having the protruding arc shape. Further, the paper press roller 14 is disposed at such a position as to come in contact with the upper limit position S, and the pickup roller 6 is disposed at a position slightly separated from the upper limit position S.

When the paper feed cassette 2 is inserted further, from the position shown in FIG. 7, by a prescribed amount in the X1 direction, the arm 12 also moves further, together with the paper feed cassette 2, in the X1 direction. As a result, as shown in FIGS. 8 and 9, the swing control portion 10*a* of the first bracket 10 comes in contact with the third guiding surface 20*c* having the protruding arc shape, and the swing control portion 16*a* of the second bracket 16 comes in contact with the fifth guiding surface 20*e*. On the other hand, the lock release member 53 (see FIG. 2) is pressed to be retracted into the paper feed cassette 2, so that the locked state of the sheet stacking plate 9 with respect to the bottom surface of the paper feed cassette 2 is released to bring the sheet stacking plate 9 to a raised state, and thus an uppermost surface of the stack of paper sheets reaches the upper limit position S. As a result, the pickup roller 6 is disposed at such a position as to come in contact with the uppermost surface of the stack of paper sheets at the upper limit position S, and the paper press roller 14 is disposed at a position separated from the upper limit position S. In a state shown in FIGS. 8 and 9, the paper feed cassette 2 has not yet reached the first position. Hereinafter, such a position of the paper feed cassette 2 that the pickup roller 6 comes in contact with the upper limit position S, which is shown in FIGS. 8 and 9, is referred to as a second position.

When the paper feed cassette 2 is inserted further, from the second position shown in FIG. 8, by a prescribed amount in the X1 direction, while a state is maintained where the swing control portion 10*a* of the first bracket 10 is in contact with the third guiding surface 20*c*, and the swing control portion 16*a* of the second bracket 16 is in contact with the fifth guiding surface 20*e*, the arm 12 moves further, together with the paper feed cassette 2, in the X1 direction. As a result, as shown in FIG. 10, the paper feed cassette 2 reaches the first position. Since the paper feed cassette 2 moves in the X1 direction in a state where the pickup roller 6 is in contact with the upper limit position S, by friction between the pickup roller 6 and an upper surface of the stack of paper sheets (or the sheet stacking plate 9), the pickup roller 6 moves along the first rotary shaft 11 to a downstream side in the insertion direction (left side in FIG. 10).

In a case where the paper feed cassette 2 is pulled out from the main body of the image forming apparatus 100, the pickup roller 6 and the paper press roller 14 swing in an order reverse to that in the above-described case. That is, from the first position shown in FIG. 10, the paper feed cassette 2 moves, together with the arm 12, in the pull-out direction (X2 direction) in a state where the pickup roller 6 is in contact with the upper limit position S, so that, as shown in FIG. 8, by friction between the pickup roller 6 and an upper surface of a stack of paper sheets (or the sheet stacking plate 9), the pickup roller 6 moves along the first rotary shaft 11 to the upstream side in the insertion direction (right direction in FIG. 10).

Moreover, after the second position shown in FIG. 8 has been reached, the swing control portion 10*a* moves upward along the second guiding surface 20*b*, so that the pickup roller 6 separates from the upper limit position S, and as shown in FIG. 7, the paper feed cassette 2 moves, together with the arm 12, in the pull-out direction (X2 direction) in a state where the paper press roller 14 is in contact with the upper limit position S. After that, via a state shown in FIG. 6, as shown in FIG. 5, the paper feed cassette 2 is pulled out in a state where the pickup roller 6 and the paper press roller 14 are both separated from the upper limit position S.

While the paper feed cassette 2 described herein is of a type in which, at the time of pulling out the paper feed cassette 2 from the main body of the image forming apparatus 100, the sheet stacking plate 9 is not brought to a lowered state, a configuration may be adopted in which, at the time of pulling out the paper feed cassette 2, the sheet stacking plate 9 is brought to a lowered state and locked to the bottom surface of the paper feed cassette 2. In this case, a configuration could be adopted in which the sheet stacking plate 9 is brought to a lowered state at a timing at which the pickup roller 6 separates from the upper limit position S and, at a point in time when the paper feed cassette 2 has been pulled out by a prescribed amount, the sheet stacking plate 9 is locked to the bottom surface of the paper feed cassette 2.

In this embodiment, a timing at which the pickup roller 6 comes in/out of contact with the upper limit position S is adjusted so that a movement amount D1 of the paper feed cassette 2 between the second position (indicated by a broken line in FIG. 10) and the first position (indicated by a solid line in FIG. 10) is substantially equal to a movable area D2 of the pickup roller 6 in a direction of the first rotary shaft 11.

According to this configuration, at the time of an operation to insert the paper feed cassette 2, the pickup roller 6 moves, together with a stack of paper sheets, always to a most downstream side in the insertion direction (most upstream side in the pull-out direction) of the first rotary shaft 11. Furthermore, at the time of an operation to pull out the paper feed cassette 2, the pickup roller 6 moves, together with a stack of paper sheets, always to the most upstream side in the insertion direction (most downstream side in the pull-out direction). This eliminates a possibility that, at the time of an operation to insert or pull out the paper feed cassette 2, an upper surface of a stack of paper sheets is rubbed against by the pickup roller 6, and thus misalignment of a paper sheet and damage to a paper sheet can be effectively suppressed. Furthermore, movement of the pickup roller 6 in the axial direction during paper feeding is considerably reduced, and thus a constant positional relationship with the feed roller 18 is established, so that a stable paper feed operation can be performed.

While in this embodiment, the movement amount D1 of the paper feed cassette 2 is set to be substantially equal to the movable area D2 of the pickup roller 6, the movable area D2 of the pickup roller 6 in the direction of the first rotary shaft 11 may be set to be larger than the movement amount D1 of the paper feed cassette 2. This can suppress misalignment of a paper sheet and damage to a paper sheet due to interference between the pickup roller 6 and an upper surface of a stack of paper sheets. In the case, however, where the movable area D2 of the pickup roller 6 is larger than the movement amount D1 of the paper feed cassette 2, at the time of an operation to insert the paper feed cassette 2, the pickup roller 6 does not necessarily move to the most downstream side in the insertion direction.

Figure 11:
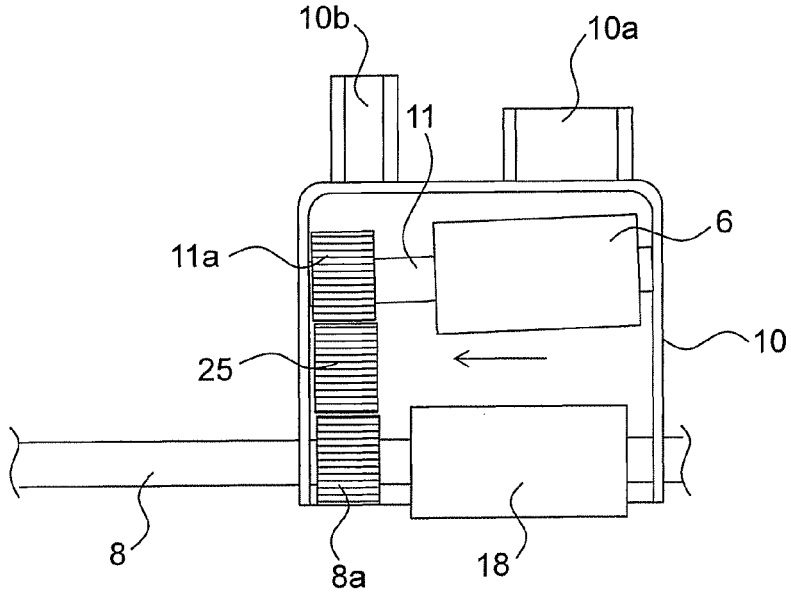
FIG. 11 is a view, as seen from a rear surface side of the first bracket 10, of the pickup roller 6 and a feed roller 18.

As a solution to this, as shown in FIG. 11, the first rotary shaft 11 of the pickup roller 6 is inclined in such a direction as to approach the feed roller 18 from the upstream side in the insertion direction (near side with respect to the image forming apparatus main body, namely, a right side in FIG. 11) toward the downstream side in the insertion direction (depth side of the image forming apparatus main body, namely, a left side in FIG. 11) so that parallelism between the feed roller 18 and the pickup roller 6 is lost. With this configuration, every time paper feeding is performed, by drag (frictional force) the pickup roller 6 receives from a paper sheet P, the pickup roller 6 moves to be increasingly closer to the downstream side in the insertion direction, and thus it is possible to, after a prescribed number of sheets have been fed, make the pickup roller 6 automatically move to the most downstream side in the insertion direction.

Even with the above-described configuration, however, in which the pickup roller 6 is made to automatically move to the most downstream side in the insertion direction, there may be a case where, at a start of paper feeding, misalignment has occurred between positions of the pickup roller 6 and the feed roller 18 in a main scanning direction. Such a case leads to movement of the pickup roller 6 in the axial direction during paper feeding, and it, therefore, cannot be said that the above-described configuration is beneficial to paper feed performance. From this viewpoint, more preferable is the configuration of this embodiment in which the movement amount D1 of the paper fed cassette 2 is set to be substantially equal to the movable area D2 of the pickup roller 6 so that, when the paper feed cassette 2 is inserted, the pickup roller 6 is disposed always on the most downstream side in the insertion direction.

In addition to the above, without being limited to the foregoing embodiment, the present disclosure can be variously modified within the spirit of the present disclosure. For example, while the foregoing embodiment includes the paper press roller 14 along with the pickup roller 6, in a case where the degree of misalignment of a paper sheet caused by a frictional force between a sheet of the paper P and the pickup roller 6 in the cassette insertion/pull-out direction is permissible, it is not necessary that the paper press roller 14 be provided.

Furthermore, while in the foregoing embodiment, in the arm 12 as a swing control body, the first bracket 10 as a pickup roller support body and the second bracket 16 as a paper press roller support body are in elastic contact with the guiding surface 20 by biasing forces of the tension coil springs 22 and 23, instead of configuring the first bracket 10 and the second bracket 16 so that they make elastic contact with the guiding surface 20, for example, a configuration may be adopted in which the arm 12 is provided with a guiding groove extending in the insertion/pull-out direction of the paper feed cassette 2, and the pivotal ends of the first bracket 10 and the second bracket 16 are engaged therewith so that guiding is performed based on this engagement.

Furthermore, while in the foregoing embodiment, the first bracket 10 and the second bracket 16 are biased in their swing directions by the tension coil springs 22 and 23, respectively, instead of using a tension coil spring, a twist spring may be mounted to the feed roller mounting shaft 8.

Furthermore, in the paper feed cassette 2, without any limitation to paper sheets, various types of sheets such as OHP sheets and label sheets can be housed.

The present disclosure is applicable to a sheet feed device that can be mounted in/demounted from an image forming apparatus and includes a sheet housing portion that is stocked beforehand with a multitude of sheets such as paper sheets and a pickup roller that feeds, one by one, the sheets thus stocked in the sheet housing portion. The use of the present disclosure provides a sheet feed device that can prevent, with increased reliability compared with conventional techniques and by using a simple configuration, positional misalignment of a sheet and damage to a sheet due to contact between a pickup roller and an uppermost sheet at the time of an operation to mount/demount a sheet housing portion in/from an image forming apparatus main body.

What is claimed is:

1. A sheet feed device mounted to an image forming apparatus, comprising:

a sheet housing portion that can be inserted in and pulled out from an image forming apparatus main body;

a sheet stacking plate that is pivotably supported, at an end portion thereof on an upstream side in a sheet feed direction, to a bottom surface of the sheet housing portion and whose end portion on a downstream side in the sheet feed direction moves up and down between a placement position at which sheets are set and a feed position at which the sheets are fed;

a pickup roller that comes in contact with an upper surface of a plurality of sheets stacked on the sheet stacking plate and feeds out, one by one, an uppermost one of the sheets in a direction orthogonal to an insertion direction or a pull-out direction of the sheet housing portion;

a feed mechanism that feeds, by using a feed roller disposed on the downstream side in the sheet feed direction with respect to the pickup roller, a sheet fed out by the pickup roller;

a first bracket that has a first rotary shaft to which the pickup roller is supported so as to be movable in the insertion direction or the pull-out direction of the sheet housing portion, and is swingably supported to the image forming apparatus main body;

an arm that is mounted to the image forming apparatus main body, is movable together with the sheet housing portion in the insertion direction or the pull-out direction in accordance with insertion or pulling out of the sheet housing portion, and makes the first bracket swing between a feed position where, when the sheet housing portion is at a first position at which mounting of the sheet housing portion in the image forming apparatus main body is completed, the arm makes sliding contact with the first bracket, and the pickup roller comes into contact with an upper surface of the sheets housed in the sheet housing portion, and a separation position where, when the sheet housing portion is at a second position to which the sheet housing portion has moved from the first position to a downstream side in the pull-out direction, the pickup roller separates from the upper surface of the sheets; and a feed roller mounting shaft that drives the feed roller to rotate and functions as a swing center of the first bracket, wherein at a time of pulling out the sheet housing portion from the image forming apparatus main body, when the sheet housing portion moves from the first position to the second position, the pickup roller moves on the first rotary shaft, through frictional contact with the upper surface of the sheets, to a position on an upstream side in the insertion direction, at a time of inserting the sheet housing portion in the image forming apparatus main body, when the sheet housing portion moves from the second position to the first position, the pickup roller moves on the first rotary shaft, through frictional contact with the upper surface of the sheets, to a position on a downstream side in the insertion direction, and a movable area of the pickup roller in a direction of the first rotary shaft is equal to or larger than a movement amount of the pickup roller between the position on the upstream side and the position on the downstream side.

2. The sheet feed device according to claim 1, wherein the movable area of the pickup roller in the direction of the first rotary shaft is substantially equal to a movement amount of the sheet housing portion between the first position and the second position.

3. The sheet feed device according to claim 1, wherein the first rotary shaft is inclined in such a direction as to approach a rotary shaft of the feed roller, which is parallel to the insertion direction or the pull-out direction of the sheet housing portion, from the upstream side to the downstream side in the insertion direction of the sheet housing portion.

4. The sheet feed device according to claim 1, wherein a first biasing member is provided that biases the first bracket in such a direction as to separate from an upper surface of either the sheets or the sheet stacking plate, and at a surface of the arm where contact is made with the first bracket, a guiding surface is formed that extends in the insertion direction or the pull-out direction of the sheet housing portion and controls a swing position of the pickup roller.

5. The sheet feed device according to claim 4, wherein a second biasing member is provided that biases the arm in the pull-out direction of the sheet housing portion, and the arm is contactable with the sheet housing portion in the insertion direction of the sheet housing portion.

6. The sheet feed device according to claim 4, wherein the guiding surface includes, in order from the downstream side in the insertion direction of the sheet housing portion, a first guiding surface that is substantially a same flat surface as a lower surface of a top plate portion mounted to the arm, a second guiding surface that is inclined in such a direction as to separate from the first guiding surface, a third guiding surface that is continuous with the second guiding surface and has a protruding arc shape, a fourth guiding surface that is inclined from the third guiding surface in such a direction as to approach the top plate portion, and a fifth guiding surface that is continuous with the fourth guiding surface and has a height from the lower surface of the top plate portion, which is larger than that of the first guiding surface and smaller than that of the third guiding surface.

7. The sheet feed device according to claim 4, wherein at a lower surface of the arm, a guiding portion is formed with which the first bracket makes sliding contact, and the guiding portion has an inclined surface having a same shape as that of the guiding surface and is formed at a position misaligned with the guiding surface toward an upstream side in the sheet feed direction and toward a downstream side in the insertion direction of the sheet housing portion.

8. The sheet feed device according to claim 1, further comprising:

a paper press roller that comes in contact with an upper surface of a plurality of sheets stacked on the sheet stacking plate and regulates movement of a sheet in the insertion direction or the pull-out direction of the sheet housing portion; and a second bracket that has a second rotary shaft to which the paper press roller is rotatably supported and is swingably supported to the image forming apparatus main body, and whose swing position is controlled by the arm, wherein at the time of inserting the sheet housing portion, the paper press roller comes in contact with an upper surface of either the sheets or the sheet stacking plate before the pickup roller does, and when the sheet housing portion reaches the first position, the paper press roller separates from the upper surface of either the sheets or the sheet stacking plate, and at the time of pulling out the sheet housing portion, the paper press roller comes in contact with the upper surface of either the sheets or the sheet stacking plate after the sheet housing portion has separated from the first position, and separates from the upper surface of either the sheets or the sheet stacking plate after the pickup roller does.

9. The sheet feed device according to claim 8, wherein a side surface of the paper press roller facing the sheet stacking plate protrudes in an arc shape in cross section.

10. The sheet feed device according to claim 1, wherein the sheet housing portion has a lock release member that switches between a locked state of the sheet stacking plate where the sheet stacking plate is locked to the bottom surface of the sheet housing portion and a state where the locked state is released, and at the time of inserting the sheet housing portion, by a time when the sheet housing portion reaches the first position, the locked state of the sheet stacking plate is released by the lock release member and thus the sheet stacking plate is raised to the feed position.

11. An image forming apparatus comprising the sheet feed device according to claim 1.

* * * * *